US006927531B2

(12) United States Patent
Ueda et al.

(10) Patent No.: US 6,927,531 B2
(45) Date of Patent: Aug. 9, 2005

(54) ELECTRON GUN AND COLOR PICTURE TUBE APPARATUS THAT ATTAIN A HIGH DEGREE OF RESOLUTION OVER THE ENTIRE SCREEN

(75) Inventors: Yasuyuki Ueda, Hirakata (JP); Masahiko Sukeno, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 157 days.

(21) Appl. No.: 10/355,852

(22) Filed: Jan. 31, 2003

(65) Prior Publication Data

US 2003/0160559 A1 Aug. 28, 2003

(30) Foreign Application Priority Data

Feb. 1, 2002 (JP) ..... 2002-025141

(51) Int. Cl.[7] ..... H01J 29/50

(52) U.S. Cl. ..... 313/414; 313/412; 313/428; 313/432; 313/437; 313/439

(58) Field of Search ..... 313/412, 414, 313/426, 428, 429, 432, 435, 437, 439, 452, 458, 460; 315/14–16, 382, 382.1

(56) References Cited

U.S. PATENT DOCUMENTS 5,212,423 A * 5/1993 Noguchi et al. ..... 313/414
5,610,481 A * 3/1997 Shirai et al. ..... 315/382
5,675,211 A * 10/1997 Ueda ..... 313/412
6,046,537 A * 4/2000 Sukeno ..... 313/414
6,320,333 B1 * 11/2001 Ueda et al. ..... 315/382
2002/0008457 A1 * 1/2002 Nakamura et al. ..... 313/414

FOREIGN PATENT DOCUMENTS

EP 000901146 A2 * 10/2001

* cited by examiner

*Primary Examiner*—Ashok Patel

(57) ABSTRACT

A set of three cathodes, a control electrode, an accelerating electrode, a first focus electrode, a second focus electrode, a third focus electrode, a fourth focus electrode, a final accelerating electrode and a shield cup electrode are provided successively in an electron beam travelling direction. The shield cup electrode has a pair of screen-shaped electrodes that sandwich electron-beam through-holes in a vertical direction. A quadrupole lens that has a horizontal convergent action and a vertical divergent action is generated by an electrical potential difference between the screen-shaped electrodes and the final accelerating electrode. Accordingly, even if vertical and horizontal convergence power difference in a main lens formed by the fourth focus electrode and the final accelerating electrode is not large, a composite lens formed through a combination of the quadrupole lens and the main lens has strong horizontal convergence power and weak vertical convergence power.

12 Claims, 14 Drawing Sheets

ELECTRON GUN AND COLOR PICTURE TUBE APPARATUS THAT ATTAIN A HIGH DEGREE OF RESOLUTION OVER THE ENTIRE SCREEN

BACKGROUND OF THE INVENTION (1) Field of the Invention

The present invention relates to an electron gun that is structured so as to attain a high degree of resolution over the entire screen, and a color picture tube apparatus that includes the electron gun.

(2) Related Art

Generally, a color picture tube apparatus has an envelope formed from a panel and a funnel joined to the panel, and displays color images by emitting three electron beams from an electron gun disposed in a neck of the funnel, onto a phosphor screen formed opposite a shadow mask on an inner surface of the panel, while scanning horizontally and vertically. The three electron beams are deflected by horizontal and vertical deflection magnetic fields generated by a deflection device mounted to the outside of the funnel.

The magnetic fields generated by the deflection device used in the above color picture tube apparatus generally have a self-convergence structure to focus the three electron beams on the screen, and as a result the horizontal and vertical deflection magnetic fields are distorted into a pincushion shape and a barrel shape, respectively. The three electron beams that pass through the deflection magnetic fields are thus subject to divergent action in the horizontal direction and convergent action in the vertical direction.

When the electron beam trajectory is lengthened due to an increase in the deflection angle, astigmatism becomes pronounced because of these self-convergence magnetic fields, particularly in outer areas of the phosphor screen surface, and horizontal resolution is reduced as a result of the electron beam spots becoming a flattened, oblong-shape along a major axis in the horizontal direction when viewed in cross-section. This problem has been accentuated in recent years as panels become flatter and deflection angles increase.

Thus, in order to portray high-resolution images on a phosphor screen, it is first necessary to reduce spot diameter in the horizontal direction with the electron gun.

A known technique that attempts to do this involves applying a voltage (dynamic voltage) to a focus electrode in the electron gun. According to this technique, a voltage that increases as the amount of electron beam deflection increases is applied to a focus electrode positioned closest to and facing a final accelerating electrode, and as a result, the action by the main lens electric field weakens as the deflection angle increases, astigmatism is corrected, and the shape of the beam spot is controlled.

Furthermore, Japanese patent No. 3,040,272 discloses a technique that adjusts the shape and orientation of the electron-beam through-holes of the electrodes and specifies conditions of voltage applied to each electrode so that the convergence power of the main lens is stronger in the horizontal direction than the vertical direction. This lowers the dynamic voltage that is applied to the focus electrode, thus reducing the size of the voltage circuit.

It is known that generally a larger electric field lens aperture reduces spherical aberrations and a smaller spot diameter is obtained. This enables improvement in resolution.

The OLF (over-lapping field) lens disclosed in Japanese examined patent application publication No. 2-18540 is an example of technology that realizes this idea by way of the electrode configuration. This OLF lens consists of three lenses that correspond to the three electron beams R, G and B. These three lenses partially overlap.

FIG. 1 is a cross-sectional diagram of the electrode configuration that forms this OLF lens. As shown in FIG. 1, the main electrodes are constituted by a focus electrode 101 and a final accelerating electrode 102 provided with a gap therebetween in a tube axis direction, and a shield cup 103 connected to final accelerating electrode 102.

The focus electrode 101 and the final accelerating electrode 102 are formed respectively from (i) tubular circumferential electrodes 101A and 102A, each of which has a horizontally wide, flattened tube-shape, and encompasses the three electron beams, and (ii) correction electrode plates 101B and 102B, each of which is set back from the facing edges of the tubular circumferential electrodes, and has three noncircular holes 101B1, 101B2, 101B3 and 102B1, 102B2, 102B3, respectively, opened therein to allow the electron beams to pass through substantially perpendicularly.

These correction electrode plates 101B and 102B generate three main lens electric fields that correspond respectively to the three electron beams.

By providing the correction electrode plates 101B and 102B back from the facing edges of the tubular circumferential electrodes 101A and 102A in the focus electrode 101 and the final accelerating electrode 102, respectively, the high potential of the final accelerating electrode 102 is allowed to incur deep into the focus electrode 101, and the low potential of the focus electrode 101 is allowed to incur deep into the final accelerating electrode 102. As a result, the lens aperture resulting from the main lens electric fields is effectively enlarged, and the spot diameter on the phosphor screen can be reduced.

However, the following two problems arise when the main lens is an OLF lens.

The first problem is that it is difficult make the convergence power of the main lens different in the horizontal and vertical directions.

Since the three lenses in an OLF lens partially overlap and interfere with each other as described above, the OLF lens has an asymmetrical three dimensional structure.

Consequently, a problem with OLF lenses is that the lens design is complicated compared to a conventional electron gun main lens.

Specifically, the convergent actions of the three lenses can be made the same by uniformly arranging the tubular cross-sectional shapes of the final accelerating electrode and the preceding focus electrode and the size of the three electron beam through-holes. However, in an OLF lens, the electric field lenses are determined by a plurality of parameters including the shape of the openings of the tubular circumferential electrodes 101 and 102, the position of the correction electrodes 101B and 102B, and the shape of the electron-beam through-holes 101B1 to 101B3 and 102B1 to 102B3.

When design of the electric field lens is so difficult, it is difficult to make a difference between horizontal and vertical convergence power of the main lens (hereinafter referred to as the "HV differential"), and the design of the HV differential of the main lens becomes limited. As a result, aligning the diameters of the electron beams in the horizontal and the vertical directions difficult, and there is little significance to the increased aperture size of the main lens that has been provided to the improve resolution.

Furthermore, when minimizing the applied dynamic voltage to reduce the size of the voltage circuit as an application of the above-described dynamic voltage technique, it is essential to ensure that the main lens has at least a set HV differential. However, as described above, in an OLF lens design difficulties make it is hard to attain the desired HV differential, and this technique is difficult to realize.

The second problem is the occurrence of mislanding which causes color discrepancy.

This second problem is described with use of FIG. 2. Three electric field lenses 201, 202 and 203 that compose the OLF lens are related to the shape of the opening of the tube-shaped electrodes that generate the OLF lens, the shape of the electron-beam through-holes in the correction electrode, and so on. As shown in FIG. 2, if overlap areas 204 of the three electric field lenses 201, 202 and 203 are increased in order to increase the diameter of the apertures, since the outer electric field lenses 201 and 203 are limited by the shape and so on of the tube-shaped electrodes, the centers of the outer electric field lenses 201 and 203 have to be moved closer to the center of the electric field lens 202, and an interval S between the center of each of the outer electric field lenses 201 and 203 and the center of the center electric field lens 202 decreases. Suppose a design in which the electron beams are pass through the effective center of the electric field lenses so as to be symmetrical on the screen 205, and the phosphor dots are provided at a set interval (pitch) on the screen 205. Here, if the interval S decreases, it is necessary to have an increased gap Q between the screen 205 and the shadow mask 207 in order to converge the three electron beams on the shadow mask 207. However, if the gap Q is increased in this way, geomagnetism between the screen 205 and the shadow mask 207 mis-aligns the trajectories of the electron beams, thus causing color discrepancies, and deterioration in resolution in the outer parts of the screen.

SUMMARY OF THE INVENTION

The present invention, which solves the above-described problems, aims to provide an electron gun and a color picture tube apparatus that, even when an HV differential of a main lens is reduced as a result of using an OLF lens as the main lens in order to attain high resolution, easily supplement the reduced HV differential, without electron beam mislanding.

In order to achieve the stated object, the present invention is a color picture tube apparatus, including: a panel that has a phosphor screen; and an electron gun that emits a plurality of electron beams toward the phosphor screen, wherein the electron gun includes: a plurality of cathodes that are arranged inline; a pair of main lens-generating tube-shaped electrodes that are provided on a trajectory of the electron beams and generate a main electric field lens, each tube-shaped electrode including at least one correction electrode plate that is positioned away from an opening of the tube-shaped electrode; and a pair of quadrupole lens-generating electrodes that are provided on the trajectory of the electron beams in a position that is closer than the main electric field lens to the phosphor screen, and generate a quadrupole electric field lens that has a convergent lens action in a horizontal direction and a divergent lens action in the vertical direction.

In this way, an OLF lens, which is the main lens, is generated by the two opposing tube-shaped electrodes, which each have an internal correction electrode. Therefore, the aperture of each lens can be increased, thus reducing spherical aberration and enabling a smaller spot on the phosphor screen.

Since a quadrupole lens for HV differential correcting, that has a convergent action in the horizontal direction and a divergent action in the vertical direction is formed on the screen side of the main lens, a lens that has a strong convergence power in the horizontal direction and a weak convergence power in the vertical direction can be attained, even in a case in which the HV differential is insufficient because the main lens is composed of an OLF lens. The HV differential of the main lens can be appropriately supplemented by the quadrupole lens provided on a screen-side of the main lens, therefore the electron beams can be optimally focused and high resolution can be attained over the whole screen.

Furthermore, even when an interval between each electron beam is shortened because the main lens is composed of an OLF lens, the static convergence of the electron beams can be adjusted by the quadrupole lens provided on the screen-side than the main lens. This eliminates the need to widen the gap between the screen and the shadow mask, and consequently prevents the problem of mislanding caused by the influence of geomagnetism between the screen and the shadow mask.

BRIEF DESCRIPTION OF THE DRAWINGS

These and other object, advantages and features of the invention will become apparent from the following description thereof taken in conjunction with the accompanying drawings which illustrate a specific embodiment of the invention.

In the drawings.

DESCRIPTION OF PREFERRED EMBODIMENTS

The following describes embodiments of the electron gun and color picture tube apparatus of the present invention, with reference to the drawings.

First, the color picture tube apparatus of an embodiment of the present invention is described.

Figure 1:
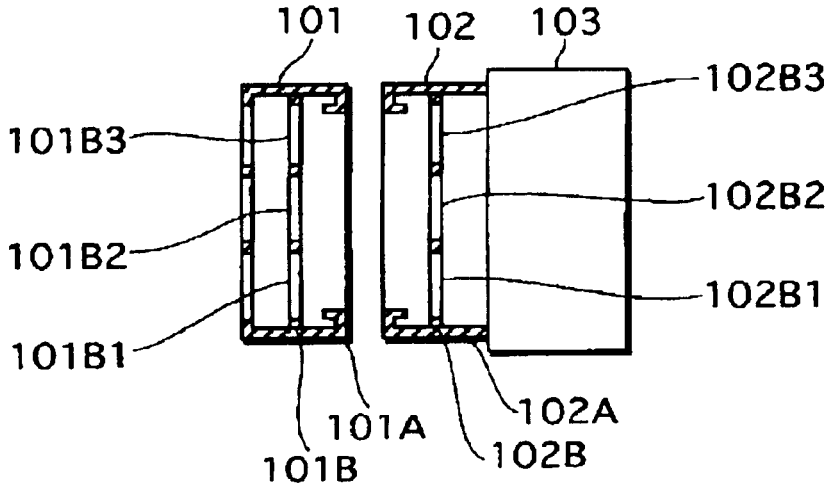
FIG. 1 is a plan view showing a structure of a conventional inline electron gun (OLF lens structure)
Figure 2:
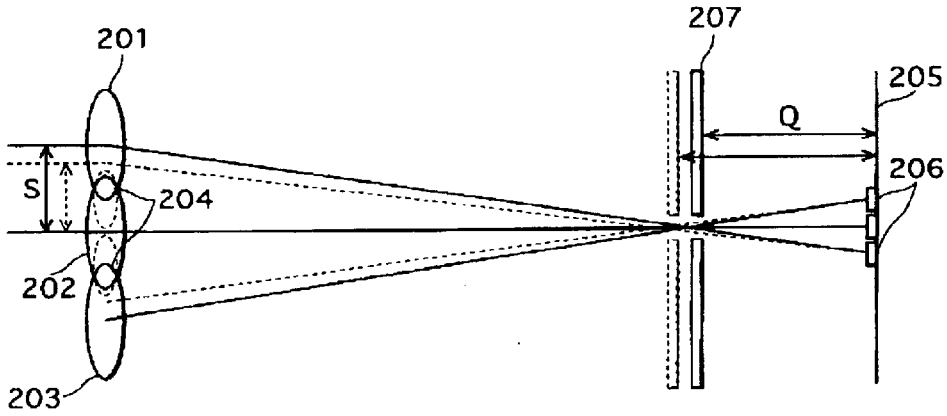
FIG. 2 is a diagram for describing the necessity to increase the distance between the shadow mask and the screen by increasing the aperture diameter of the main lenses.
Figure 3:
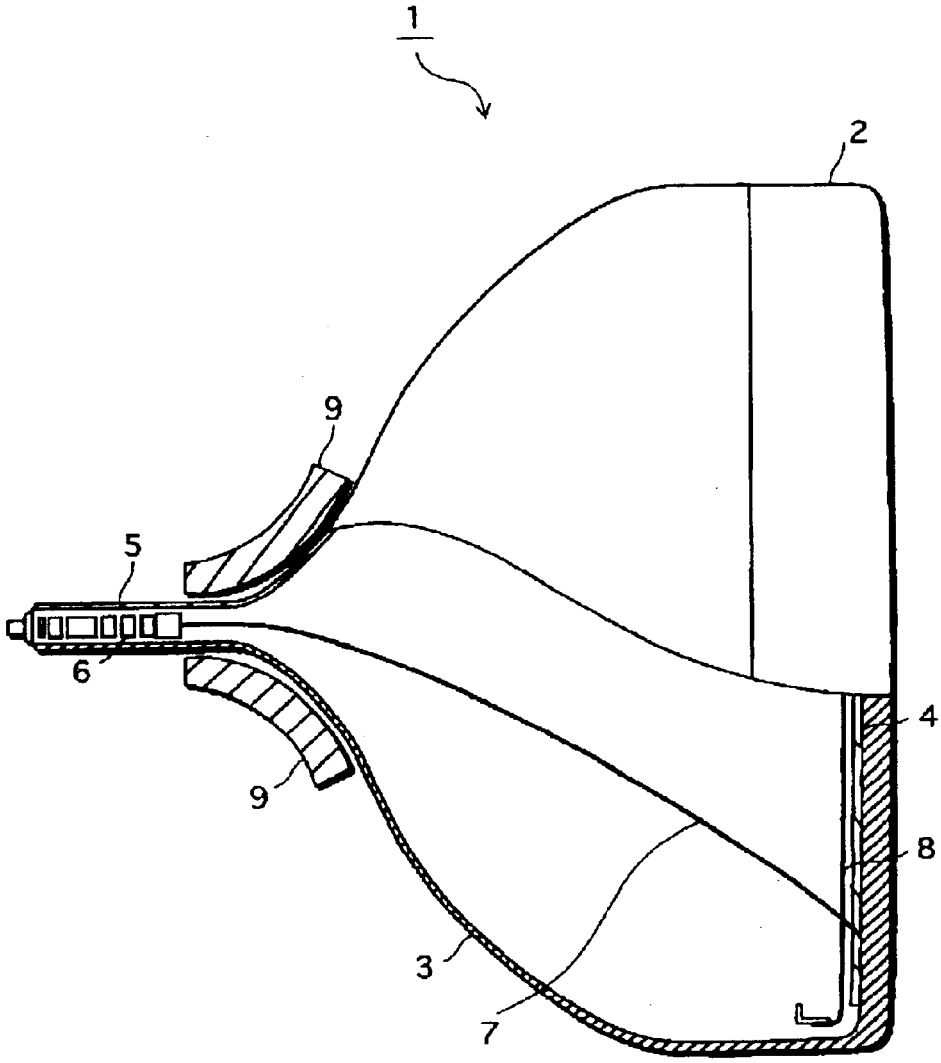
FIG. 3 is a cross-sectional diagram of the color picture tube apparatus of the present invention partly cut away.

FIG. 3 is a cross-sectional diagram of the color picture tube apparatus of the present invention partly cut away.

As the FIG. 3 shows, a color picture tube apparatus 1 has an envelope that is composed of a panel 2 and a funnel 3. A phosphor screen 4 is formed on the inner surface of the panel 4 by applying blue, green and red phosphor. An inline electron gun 6 is housed in a neck portion 5 of the funnel 3 that faces the phosphor screen 4. Electron beams 7 that correspond to the colors of phosphor are emitted from the electron gun 6 in accordance with input signals, and pass through a deflection magnetic field which is generated by a deflection apparatus 9. The deflection apparatus 9 is composed of a horizontal deflection coil and a vertical deflection coil, and is provided along a boundary of the neck portion 5 and the funnel 3. The electron beams 7 are deflected a predetermined amount by the deflection magnetic field in horizontal and vertical directions, pass through holes that are formed in a shadow mask 8, and reach the phosphor screen 4.

The following describes in detail embodiments of the electron gun provided in the color picture tube apparatus 1.

<First Embodiment>

Figure 4:
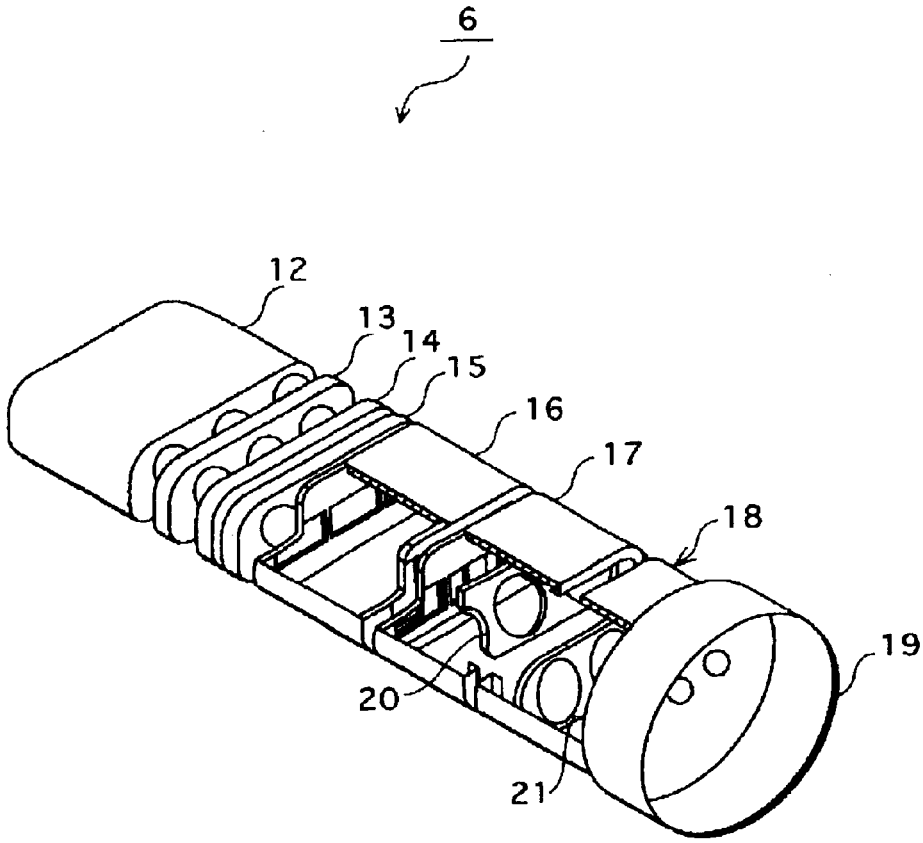
FIG. 4 is a perspective diagram showing the structure of an inline electron gun in a first embodiment.
Figure 5:
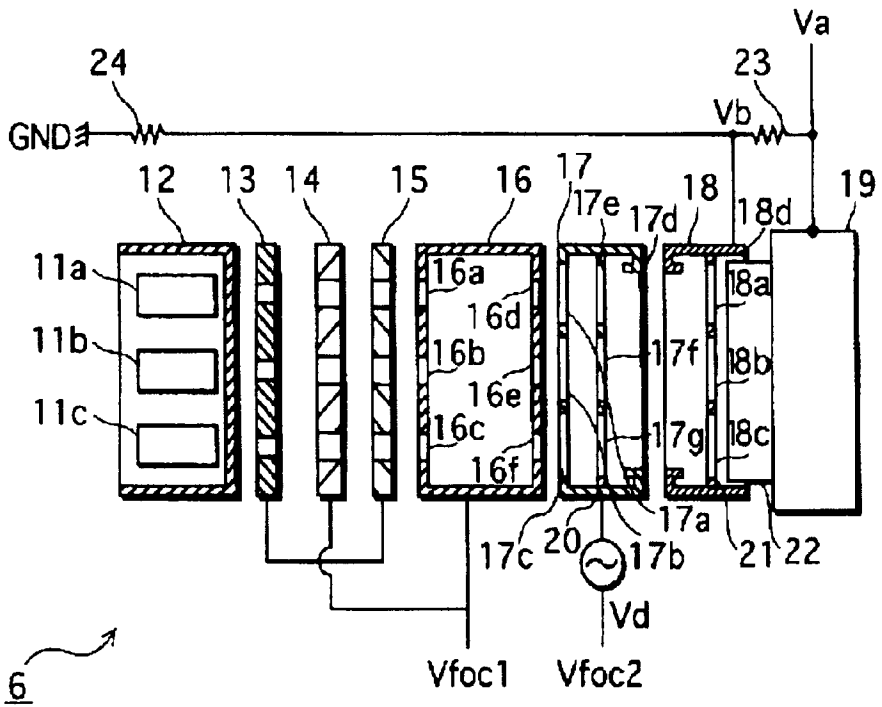
FIG. 5 is a schematic cross-sectional diagram of the electron gun of the first embodiment of the present invention.

FIG. 4 is a perspective diagram showing the structure of an inline electron gun in a first embodiment partially cut away, and FIG. 5 is a cross-sectional diagram of the electron gun 6 of FIG. 4 seen from a vertical direction.

As these drawings show, the electron gun 6 includes a set of three cathodes 11*a*, 11*b* and 11*c* provided inline (see FIG. 5), and, provided successively, a control electrode 12 that houses the cathodes 11*a*, 11*b* and 11*c*, an accelerating electrode 13, a first focus electrode 14, a second focus electrode 15, a third focus electrode 16, a fourth focus electrode 17, a final accelerating electrode 18 and a shield cup 19. These electrodes are supported by an insulated frame (not illustrated) in order to preserve their mutual positional relationship.

The control electrode 12, the accelerating electrode 13, the first focus electrode 14 and the second focus electrode 15 are each provided with three substantially round electron-beam through-holes that correspond respectively to the R, G and B electron beams.

Figure 6A:
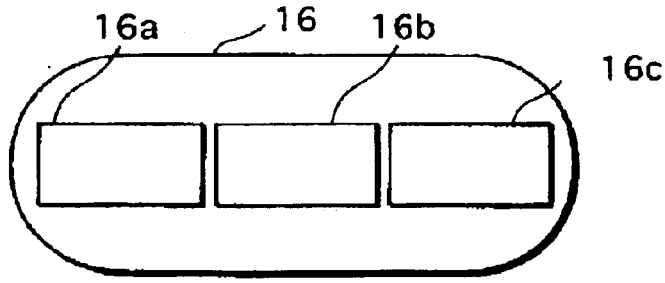
FIGS. 6A and 6B show the shape of electron-beam through-holes in a third electrode.
Figure 6B:
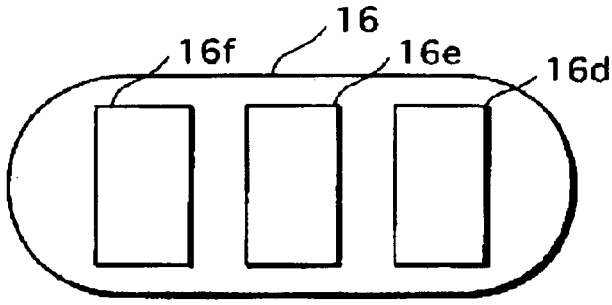

Three horizontally rectangular electron-beam through-holes 16*a*, 16*b* and 16*c* are formed in an end surface of the third focus electrode 16 facing the second focus electrode 15, as shown in FIG. 6A. Three vertically rectangular electron-beam through-holes 16*d*, 16*e* and 16*f* are formed in an end surface of the third focus electrode 16 facing fourth focus electrode 17, as shown in FIG. 6B.

Furthermore, three horizontally rectangular electron-beam through-holes 17*a*, 17*b* and 17*c*, the same as shown in FIG. 6A, are formed in an end side of the fourth focus electrode 17 facing the third focus electrode 16. One opening 17*d* is formed in the end surface of the fourth focus electrode 17 facing the final accelerating electrode 18.

Figure 7:
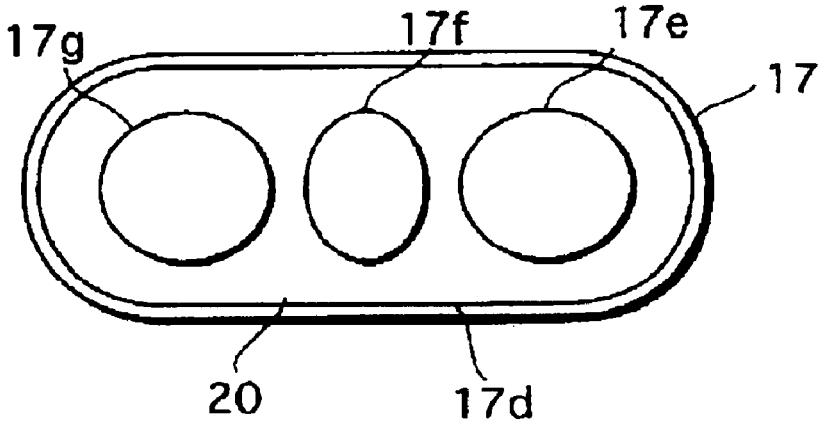
FIG. 7 shows the shape of electron-beam through-holes in a correction electrode inside a fourth electrode.

A correction electrode 20 is provided inside the fourth focus electrode 17. As shown in FIG. 7, the correction electrode 20 is a plate that has three non-circular electron beam holes 17*e*, 17*f* and 17*g*. This correction electrode 20 is positioned slightly back from the end facing the final acceleration electrode 18.

The final accelerating electrode 18 has one opening on each of a fourth focus electrode 17 side and a shield cup electrode 19 side. The final accelerating electrode 18 includes an internal correction electrode 21 that is a plate that has three non-circular electron-beam through-holes 18*a*, 18*b* and 18*c*, substantially the same as FIG. 7. The correction electrode 21 is positioned slightly back from the end facing the fourth focus electrode 17. The respective openings of the fourth focus electrode 17 and the final accelerating electrode 18 are positioned facing each other., and an OLF lens is formed between the two electrodes by applying a higher voltage to the final accelerating electrode 18 than to the fourth focus electrode 17.

Figure 8:
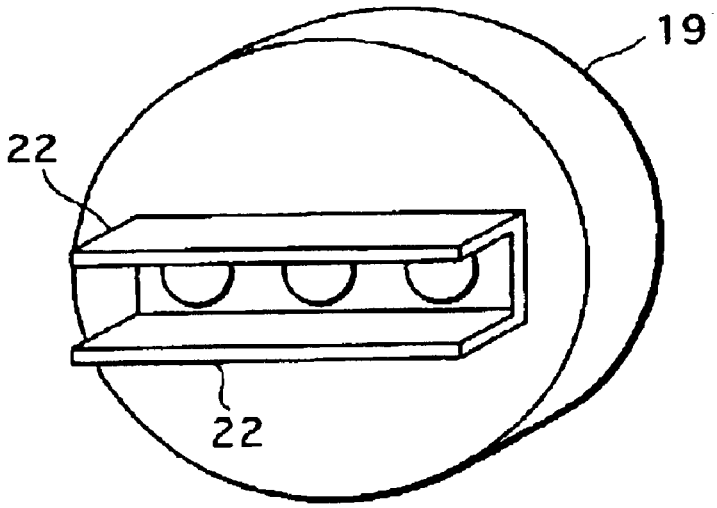
FIG. 8 is a perspective diagram of the appearance of screen electrodes that are provided on a shield cup in the electron gun of the first embodiment of the present invention.

A pair of screen-shaped electrodes 22 and 22 are provided on an end of the shield cup electrode 19 facing the final accelerating electrode 18 so as to sandwich electron-beam through-holes in a vertical direction, as shown in FIG. 8. At least part of the ends (final accelerating electrode 18 side) of these screen-shaped electrodes 22 are positioned in an opening 18*d* in the final accelerating electrode 18.

The final accelerating electrode 18 and the shield cup electrode 19 are electrically connected via a resistor 23, and the final accelerating electrode 18 is earthed via a resistor 24.

In the electron gun 6 structured as described, a set focus voltage is applied to the accelerating electrode 13 and the second focus electrode 15. A set focus voltage Vfoc1 is applied to the first focus electrode 14 and the third focus electrode 16, and a dynamic voltage Vd is applied to the fourth focus electrode 17. This dynamic voltage Vd starts from a focus voltage Vfoc2 and gradually increases as the electron beam deflection angle increases. Here, the focus voltage Vfoc1 and the focus voltage Vfoc2 fulfill a relationship Vfoc1>Vfoc2 when the electron beams are not being deflected.

A set high voltage Va is applied to the shield cup electrode 19. When this high voltage Va is being applied to the shield cup electrode 19, a voltage Vb that is due to a voltage drop by the resistor 23 is applied to the final accelerating electrode 18.

In the electron gun of the present embodiment, the voltage applied to the accelerating electrode 13 and the second focus electrode 15 is set to be 500 V, Vfoc1 is set to be 7.2 kV, Vfoc2 is set to be 5.2 kV and Va is set to be 29.5 kV, when the electron beams are not being deflected. The resistors 23 and 24 have a total resistance value of 1 to 2 GΩ, at a ratio of the resistors set so that the electric potential Vb applied to the final accelerating electrode 18 is 26 kV.

When voltages are applied to the electrodes as described above, a pre-focus lens is generated between the accelerating electrode 13 and the first focus electrode 14. This pre-focus lens is used to adjust the angle of divergence at which the electron beams are incident to the main lens. The electric field lenses generated by the first focus electrode 14 and the second focus electrode 15, and by the second focus electrode 15 and the third focus electrode 16, respectively, are unipotential, and function to support the preliminary focusing of the pre-focusing lens.

As described above, voltages Vfoc1 and Vfoc2 are applied to the third focus electrode 16 and the fourth focus electrode 17 respectively, so as to fulfill a relationship Vfoc1>Vfoc2 when the electron beams are not being deflected (Vd=0) As the deflection angle of the electron beams increases, the dynamic voltage applied to the fourth focus electrode 17 causes the electric potential of the fourth focus electrode 17 to gradually become higher than the electric potential of the third focus electrode 16, thus generating a quadrupole lens (asymmetrical electric field lens) between the third focus electrode 16 and the fourth focus electrode 17. Note that the quadrupole lens generated between the electrodes 16 and 17 is hereinafter referred to as the "first quadrupole lens" in order to distinguish it from another quadrupole lens described later that is provided behind the main lens.

When the electric potential of the fourth focus electrode 17 exceeds that of the third focus electrode 16 according to dynamic voltage being applied as the electron beam deflection angle increases, the first quadrupole lens has a convergent action in the horizontal direction and a divergent action in the vertical direction on the electron beams that pass therethrough. This negates the horizontal divergence and the vertical convergence of the electron beams caused by the self-convergence deflection magnetic field described earlier.

Furthermore, by applying dynamic voltage, the electric potential of the fourth focus electrode 17 becomes closer to the electric potential of the final accelerating lens 18, and consequently the action of the, main lens generated between the electrodes 17 and 18 weakens. When the amount of electron beam deflection increases, thus lengthening the trajectory to the screen, the convergence power of the lens weakens.

Consequently, an optimal focus condition can be maintained in the horizontal direction and the vertical direction according to the two electric field lenses, in other words, the quadrupole lens and the main lens, and beam spots can be generated without a haze portion.

This enables relatively high resolution to be attained over the whole screen.

Parts of the three electric field lenses between the fourth focus electrode 17 and the final accelerating electrode 18 overlap, thus interfering with each other and forming an OLF that has an asymmetrical three dimensional structure. Formation principles of the OLF lens are described in detail in Japanese examined patent application publication No. 2-118540, and therefore a description is omitted here.

Note that the shape of the OLF lens is determined by factors including the shape of openings of the tube-shaped electrodes, the positions of the correction electrodes, and the shape of the electron-beam through-holes in the correction electrodes.

Furthermore, when the electron beam is not being deflected, a second quadrupole lens is generated between the final accelerating electrode 18 and the shield cup electrode 19. The second quadrupole lens has a common effect on the three electron beams of a convergent action in the horizontal direction, in other words the inline direction, and a divergent action in the vertical direction.

Figure 9A:
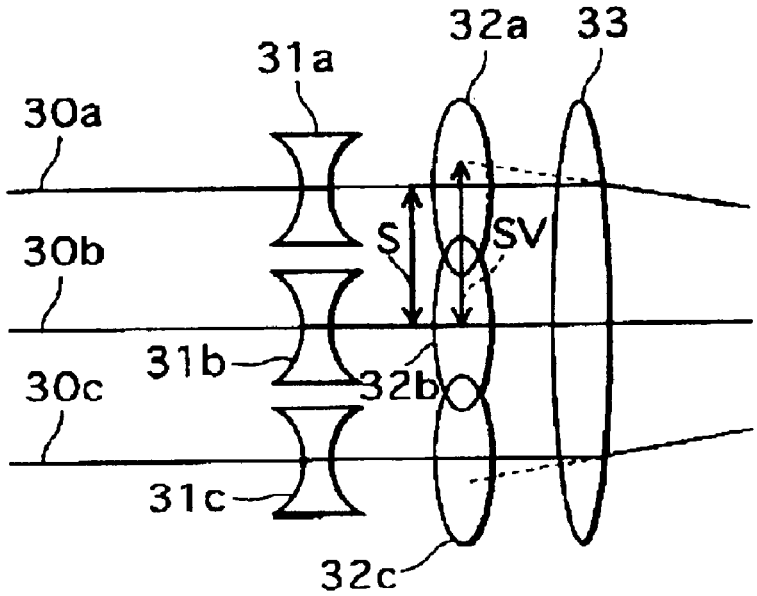
FIGS. 9A and 9B shows actions of the electric field lenses in the first embodiment of the present invention.
Figure 9B:
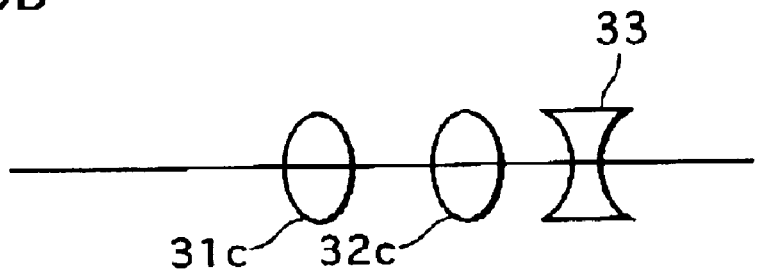

The effects of the first quadrupole lens, the main lens and the second quadrupole lens are described with use of FIGS. 9A and 9B. Note that FIG. 9A is a plan view of, from among the electric field lenses generated in the electron gun 6 of the first embodiment of the present invention when the electron beams are not being deflected, only the first quadrupole lens, the main lens and the second quadrupole lens. FIG. 9B is a side view of FIG. 9A.

As shown in FIG. 9A, in the electron gun 6, first quadrupole lenses 31*a*, 31*b* and 31*c*, and three electric field lenses 32*a*, 32*b* and 32*c* that compose the OLF lens, and correspond respectively to three RGB electron beams 30*a*, 30*b* and 30*c*, are generated. A second quadrupole lens 33 that is common to the three electron beams is also generated.

As can be seen from FIGS. 9A and 9B in conjunction, the first quadrupole lenses 31*a*, 31*b* and 31*c* have a divergent action in the horizontal direction, while the electric field lenses 32*a*, 32*b* and 32*c* of the main lens, and the second quadrupole lens 33 have a convergent action in the horizontal direction.

Furthermore, the first quadrupole lenses 31*a*, 31*b* and 31*c* and the electric field lenses 32*a*, 32*b* and 32*c* have a convergent action, while the second quadrupole lens 33 have a divergent action in the vertical direction.

As shown in FIG. 9A, the electron beams 30*a* and 30*c*, which are on either side of the central electron beam 30*b*, are deflected towards the central electron beam 30*b* by the action of the second quadrupole lens 33. This has an effect on static convergence.

The following describes two advantages obtained from adjusting static convergence with the second quadrupole lens 33.

The first advantage is that the main lens can be given a less complicated design because static convergence is not adjusted using only the main lenses 32*a*, 32*b* and 32*c*. This lightens the design load of the main lenses, and means that the main lens can be designed taking into consideration performance including lens aperture diameter, HV differential and evenness of focus between R, G and B.

The second advantage is that the stated second problem, specifically, the problem of mislanding caused by geomagnetic influence that accompanies the increase in size of the main lens when an OLF lens is employed as the main lens, is solved.

This problem is caused by a reduced interval S between the center of the center electric field lens 32*b* and the center of each of the outer electric field lenses 32*a* and 32*c* decreasing in the OLF lens shown in FIG. 9A. However, in the electron gun 6 of the present embodiment, the outer electron beams 30*a* and 30*c* are not bent by the electric field lenses 32*a* and 32*c*, but are instead bent by the second quadrupole lens 33, therefore, even if the interval S at which the electron beams pass through the main lens in reduced, the beams appear to have passed through the main lens at an interval Sv that is greater than the interval S.

Consequently, since the interval S does not change in essence, the problem of mislanding caused by geomagnetic influence when the gap between the shadow mask and the screen is increased is prevented.

Furthermore, since in the electron gun of the present embodiment the second quadrupole lens 33 which has a convergent action in the horizontal direction and a divergent action in the vertical direction is formed on the screen side of the main lens in this way, even if the HV differential is not great in the OLF lens that is used as the main lens, and even in an extreme case when convergence power is equal in the horizontal and vertical directions, a composite lens made up of the second quadrupole lens and the main lens has strong convergence power in the horizontal direction and weak convergence power in the vertical direction.

Consequently, optimal focus can be maintained in the horizontal direction according to the effects of the three electric field lenses: the first quadrupole lens, the main lens and the second quadrupole lens. Therefore, beam spots can be generated without a haze portion even in the vertical direction, and the smaller beam spot diameter that is achieved by employing an OLF lens enables higher resolution to be obtained over the whole screen than with a conventional electron gun.

In addition, in the electron gun of the present embodiment, according to the design of capacitance between the shield cup electrode 19 and the final accelerating electrode 18, it is possible to weaken the action of the second quadrupole lens 33 by adding dynamic voltage to the final accelerating electrode 18 when applying dynamic voltage to the fourth focus electrode 17. For example, supposing that the capacitance between the electrodes 17 and 18 is C1, and the capacitance between the electrode 18 and the shield cup electrode 19 is C2. The dynamic voltage added to the electrode 18 is determined by the ratio of C1 to C2, and increases as C1 increases in relation to C2. When C1=C2, half the dynamic voltage is added to the electrode 18.

By weakening the second quadrupole lens 33 in this way as the deflection angle increases, the electron beams tend towards under-convergence. This removes the need to strongly distort pincushion distortion caused by the deflection magnetic field of the deflection yoke, and has the effect of reducing deflection aberration.

<Second Embodiment>

The following describes an electron gun in a second embodiment of the present invention.

The electron gun of the present embodiment generates, in the same manner as the electron gun of the first embodiment, a first quadrupole lens that on the cathode side of the main lens and that has a divergent action in the horizontal direction and a convergent action in the vertical direction, and also generates a second quadrupole lens that is on the screen side of the main lens and that has a convergent action in the horizontal direction and a divergent action in the vertical direction.

Figure 10:
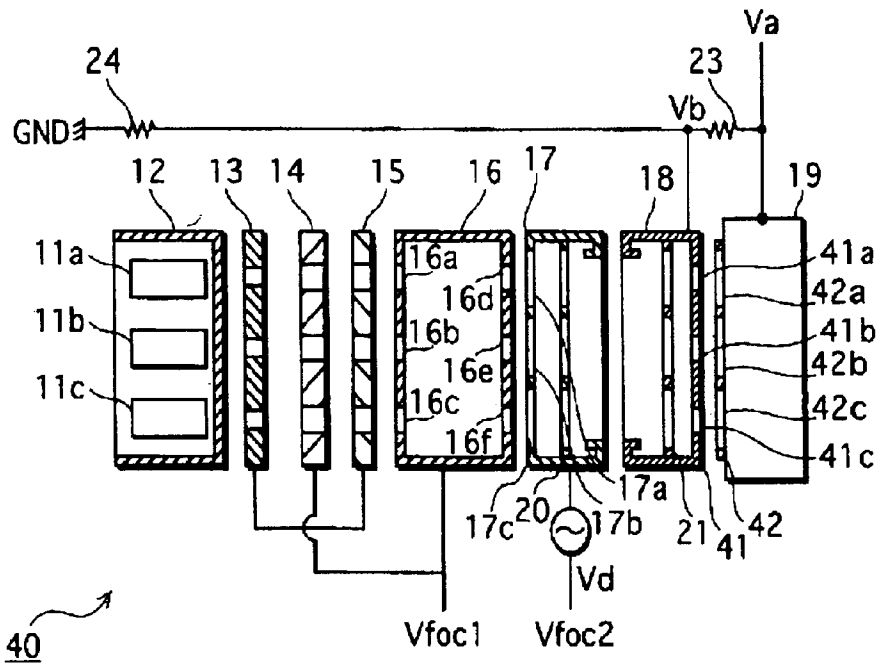
FIG. 10 is a schematic cross-sectional diagram of an electron gun of a second embodiment of the present invention.

In contrast to the electron gun 6 in which, as shown in FIGS. 5 and 8, the shield cup 19 that has the screen-shaped electrodes and the final accelerating electrode 18 generate the second quadrupole lens, in the present embodiment, the second quadrupole lens is generated, as shown in FIG. 10, by the final accelerating electrode 18 that has a plate electrode 41 provided on the shield cup electrode 19 side, and the shield cup electrode 19 that has a plate electrode 42 provided on the final accelerating electrode 18 side.

FIG. 10 is a schematic cross-sectional diagram showing the structure of an electron gun 40 in the second embodiment. Components that have the same reference numbers as the electron gun 6 in the first embodiment shown in FIG. 5 are the same thereas, and therefore are not described here. The voltages and resistance values of the resistors are the same as the electron gun 6.

Figure 11A:
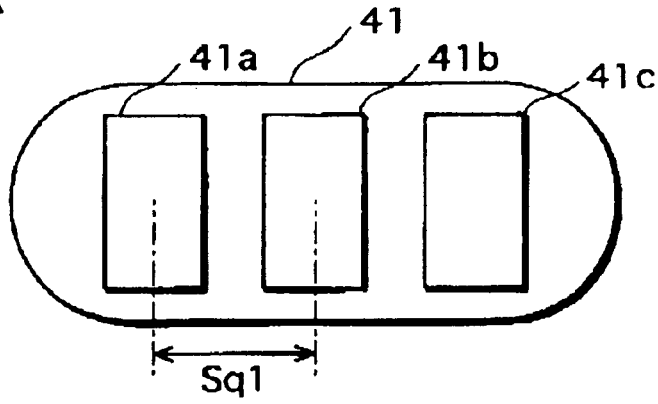
FIGS. 11A and 11B respectively show the shapes of the electron-beam through-holes on the shield cup-side of a final accelerating electrode in the electron gun in the second embodiment, and the shapes the electron-beam through-holes on the final accelerating electrode-side of the shield cup in the electron gun of the second embodiment.
Figure 11B:
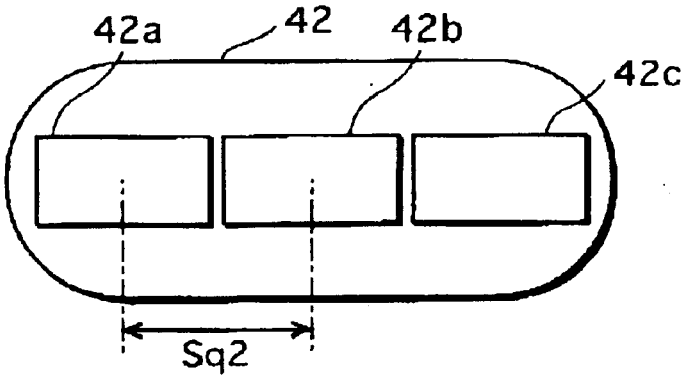

Vertically rectangular electron-beam through-holes 41*a*, 41*b* and 41*c* are formed as shown in FIG. 11A in the plate electrode 41 of the final accelerating electrode 18 in the electron gun 40. Similarly, horizontally rectangular electron-beam through-holes 42*a*, 42*b* and 42*c* are formed as shown in FIG. 11B the plate electrode 42 of the shield cup electrode 19.

When the distance between the center of the central electron-beam through-hole 41*b* and the center of the outer electron-beam through-hole 41*a* is Sq1, and the distance between the center of the central electron-beam through-hole 42*b* and the center of the outer electron-beam through-hole 42*b* is Sq2, the central axes of opposing electron-beam through-holes are displaced because of a relationship Sq1<Sq2.

In the electron beam gun 40 of the second embodiment of the present invention, the second quadrupole that is generated between the final accelerating electrode 18 and the shield cup electrode 19 is not one electric field lens that is common to the three electron beams, but is instead three separate independent electric field lenses that correspond respectively to the three electron beams. Since the relationship between the electron-beam through-hole distances Sq1 and Sq2 is made to be S1<Sq1 so that the electron beams that pass through the side electron-beam through-holes 41*a* and 41*c* are displaced from the central axes of the side electron-beam through-holes 42*a* and 42*c*, an effect of bending the side electron beams towards the central electron beam is obtained.

Figure 12A:
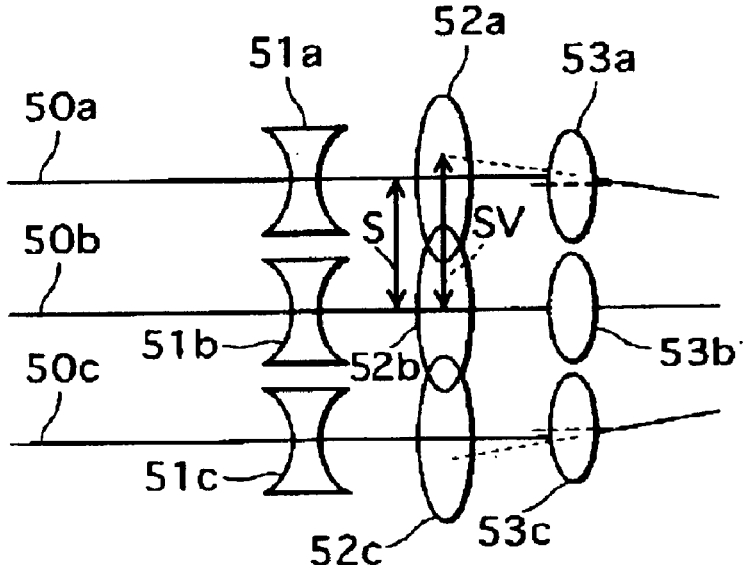
FIGS. 12A and 12B show actions of the electric field lenses in the third embodiment of the present invention.
Figure 12B:
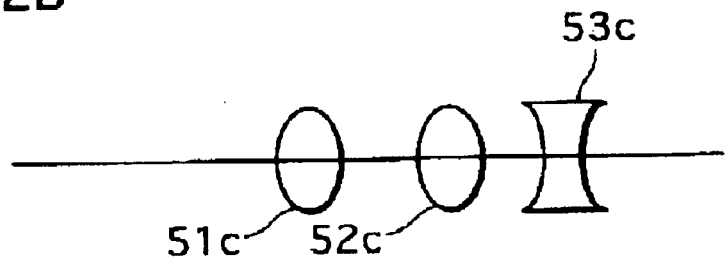

This effect is described with use of FIGS. 12A and 12B. Note that FIG. 12A is a plan view that shows, of the electric field lenses in the electron gun 40 in the second embodiment, only the first quadrupole lens, the main lens and the second quadrupole lens. FIG. 12B is a side view of FIG. 12A.

As shown in FIG. 12A, in the electron gun 40, first quadrupole lenses 51*a*, 51*b* and 51*c*, and three electric field lenses 52*a*, 52*b* and 52*c* that compose the OLF lens, are generated. The lenses 51*a* to 51*c* and 52*a* to 52*c* correspond respectively to three RGB electron beams 50*a*, 50*b* and 50*c*. In addition, three electric field lenses 53*a*, 53*b* and 53*c* that compose a second quadrupole lens and that also correspond respectively to the electron beams are generated. The first quadrupole lenses 51*a*, 51*b* and 52*c*, the three electric field lenses 52*a*, 52*b* and 52*c*, and the three electric field lenses 53*a*, 53*b* and 53*c* are generated inline with each other in the horizontal direction.

As FIG. 12A shows, the first quadrupole lenses 51*a*, 51*b* and 51*c* have a divergent action in the horizontal direction, while the electric field lenses 52*a*, 52*b* and 52*c* and the second quadrupole lens electric field lenses 53*a*, 53*b* and 53*c* have convergent action in the horizontal direction. As shown in FIG. 12B, the first quadrupole lenses 51*a*, 51*b* and 51*c* and the electric field lenses 52*a*, 52*b* and 52*c* have a convergent action in the vertical direction, while the second quadrupole lens electric field lenses 53*a*, 53*b* and 53*c* have a divergent action in the vertical direction.

In the present embodiment, the side electron beams 50*a* and 50*c* that pass through the center of the side electric field lenses 52*a* and 52*c*, respectively, of the main lens pass through the side electric field lenses 53*a* and 53*c* of the second quadrupole further towards the outer sides of the electric field lenses 53*a* and 53*c* than the respective lens centers consequently, the lens actions of the side electric field lenses 53*a* and 53*c* deflect the side electron beams 50*a* and 50*b* towards the central electron beam 50*b*, as shown in FIG. 12A. This obtains the same kind of static convergence effect as in the electron gun 6 in the first embodiment.

Furthermore, since the side electron beams 50*a* and 50*c* are not bent by the electric field lenses 52*a* and 52*c*, but are instead bent by the side electric field lenses 53*a* and 53*c* of the second quadrupole lens, even if the interval S at which the electron beams pass through the main lens in reduced, the beams appear to have passed through the main lens at an interval Sv that is greater than the interval S.

Consequently, since the interval S does not change in essence, the problem of mislanding caused by geomagnetic influence when the gap between the shadow mask and the screen is increased is prevented.

Note that other effects are not described since they are the same as for the electron gun 6 in the first embodiment.

<Third Embodiment>

The following describes an electron gun 60 in a third embodiment of the present invention.

Figure 13:
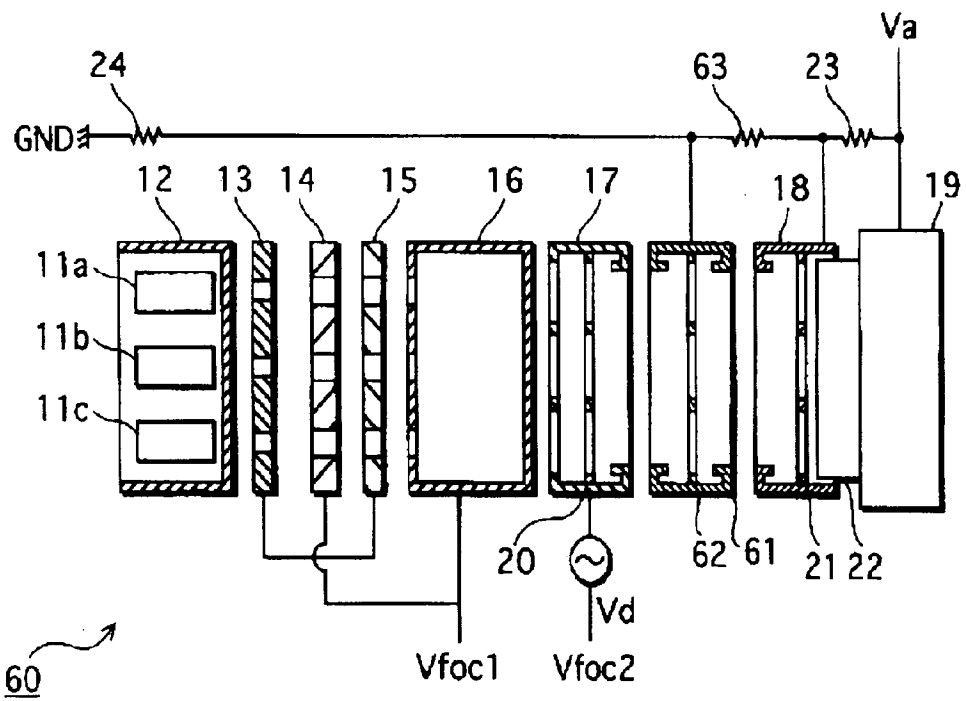
FIG. 13 is a schematic cross-sectional diagram of an electron gun in the third embodiment of the present invention.

FIG. 13 is a schematic cross-sectional diagram of the electron gun 60 in the third embodiment. Components in the present embodiment have the same reference numerals as the first embodiment shown in FIG. 5 are the same thereas, and are therefore not described here. The voltages and resistance values of the resistors are the same as the electron gun 6.

As shown in FIG. 13, the electron gun 60 in the present embodiment differs from the electron gun 6 in the first embodiment in that a tube-shaped intermediate electrode 61 is provided between the fourth focus electrode 17 and the final accelerating electrode 18.

The intermediate electrode 61 has one opening on each of a fourth focus electrode 17 side and a final accelerating electrode 18 side. A plate-shaped correction electrode 62 is provided in a central part of the intermediate electrode 61. The correction electrode 62 has three non-circular electron-beam through-holes, the same as shown in FIG. 7. The intermediate electrode 61 and the final accelerating electrode 18 are electrically connected via a resistor 63.

In the present embodiment, the main lens is generated by the fourth focus electrode 17, the intermediate electrode 61 and the final accelerating electrode 18. In the same manner as the electron gun 6 in the first embodiment, a first quadrupole lens having a divergent action in the horizontal direction and a convergent action in the vertical direction when the electron beams are not being deflected is generated on the cathode side of the main lens, and a second quadrupole lens having a convergent action in the horizontal direction and a divergent action in the vertical direction when the electron beams are not being deflected is generated on the screen side of the main lens.

The resistance value of the resistor 63 is set so that the electric potential of the intermediate electrode 61 is 10 to 13 kV.

As described, in the electron gun 60 in the third embodiment, one main lens is composed of the three electrodes, i.e., the fourth focus electrode 17, the intermediate electrode 62 and the final accelerating electrode 18. This main lens is one lens that extends in the tube axis direction. Consequently, each of the apertures of the electric field lenses that compose the main lens is effectively larger than in the electron gun in the first embodiment.

Note that effects of the main lens in the present embodiment are not described since they are the same as for the electron gun 6 in the first embodiment shown in FIG. 5. Other effects of the present embodiment are also the same as the first embodiment, and are therefore not described here.

Although the electron gun 60 in the present embodiment is described as forming the main lens with three electrodes, the main lens may be formed with more than three electrodes in order to further increase the size of the lens aperture.

Furthermore, although the electrodes for forming the OLF lens are described here as each being tube-shaped and provided internally with a plate-shaped correction electrode that has three non-rounded electron-beam through-holes such as shown in FIG. 7, the shape and size of the electron-beam through-holes may be varied as necessary as long as an OLF lens can be formed. The shape of the opening of the outer electrode is not limited to being a flattened oval shape, but may be varied to a degree.

Figure 14A:
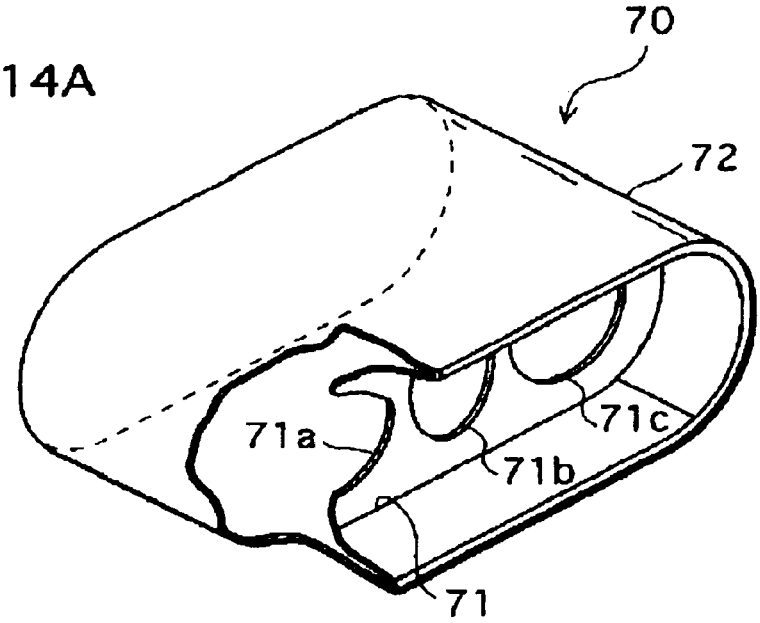
FIGS. 14A and 14B are, respectively, a partially cut out perspective diagram and a horizontal cross section diagram of a modification of a focus electrode for forming an OLF lens.
Figure 14B:
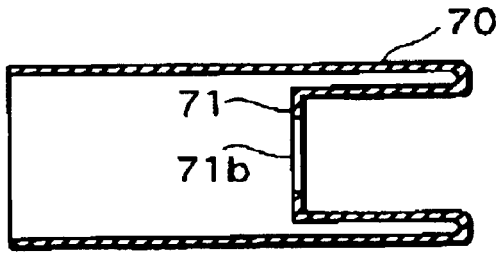

Furthermore, the tube-shaped outer electrode and the internal correction electrode may be formed integrally. FIG. 14A is a perspective diagram showing a partly-cut out focus electrode 70 for forming an OLF lens, manufactured integrally. FIG. 14B vertical cross-sectional view of the focus electrode 70.

This kind of focus electrode can be easily formed by, for example, using a press process or the like to push a bottom part of a tube-shaped member inside itself to make the correction electrode, and then forming the electron-beam through-holes 71*a*, 71*b* and 71*c* in the pressed-in part.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A color picture tube apparatus, comprising:

a panel that has a phosphor screen; and an electron gun that emits a plurality of electron beams toward the phosphor screen, wherein the electron gun includes:

a plurality of cathodes that are arranged inline;

a pair of main lens-generating tube-shaped electrodes that are provided on a trajectory of the electron beams and generate a main electric field lens, each tube-shaped electrode including at least one correction electrode plate that is positioned away from an opening of the tube-shaped electrode; and a pair of quadrupole lens-generating electrodes that are provided on the trajectory of the electron beams in a position that is closer than the main electric field lens to the phosphor screen, and generate a quadrupole electric field lens that has a convergent lens action in a horizontal direction and a divergent lens action in the vertical direction.

2. The color picture tube apparatus of claim 1, wherein the tube-shaped electrode that is closer to the cathodes has applied thereto a voltage to which a dynamic voltage is superimposed, the dynamic voltage fluctuating according to an amount that the electron beams are deflected.

3. The color picture tube apparatus of claim 1, wherein the quadrupole electric field lens has an action of causing the electron beams to converge toward a central electron beam in the horizontal direction.

4. The color picture tube apparatus of claim 3, wherein the quadrupole electric field lens is one common electric field lens through which the electron beams pass.

5. The color picture tube apparatus of claim 3, wherein the quadrupole electric field lens is made up of a plurality of independent electric field lenses that correspond respectively to the electron beams, a distance between the center of each independent electric field lens being shorter than a distance between electron beams that are incident thereto, and each electron beam, excluding a central electron beam, being incident to the corresponding independent electric field lens outside of the center of the lens.

6. The color picture tube apparatus of claim 1, further comprising:

a tube-shaped supplementary electrode that is arranged between the pair of tube-shaped electrodes coaxially with the tube-shaped electrodes, a voltage applied to the supplementary electrode being lower than a voltage applied to the tube-shaped electrode that is closer to the phosphor screen.

7. The color picture tube apparatus of claim 1, wherein the tube-shaped electrode that is closer to the phosphor screen is a final accelerating electrode, and also serves as the quadrupole lens-generating electrode that is closer to the cathodes, the pair of quadrupole lens-generating electrodes being composed of the final accelerating electrode and a shield cup electrode that is provided closer than the final accelerating electrode to the phosphor screen, and the quadrupole lens is generated according to an electric potential difference between the final accelerating electrode and the shield cup electrode.

8. The color picture tube apparatus of claim 7, wherein a pair of screen-shaped electrodes is provided on a final accelerating electrode-side surface of the shield cup electrode so as to sandwich electron-beam through-holes in a vertical direction and extend from the surface towards the final accelerating electrode, at least part of a tip of each screen-shaped electrode being in an opening of the final accelerating electrode.

9. The color picture tube apparatus of claim 7, wherein a first electrode plate is provided at a shield cup electrode-end of the final accelerating electrode, the first electrode plate having a plurality of vertically rectangular electron-beam through-holes, a second electrode plate is provided at an end of the shield cup electrode that faces the first electrode plate, the second electrode having a plurality of horizontally rectangular electron-beam through-holes, and a distance in the horizontal direction between a center of each electron-beam through-hole in the second electrode plate is shorter than a distance in the horizontal direction between a center of each electron-beam through-hole in the first electrode plate.

10. The color picture tube apparatus of claim 7, wherein the final accelerating electrode and the shield cup electrode are connected via a resistor, and a potential of the final accelerating electrode is lower than the shield cup electrode due to a voltage drop by the resistor.

11. The color picture tube apparatus of claim 1, further comprising:

a focus electrode that is arranged on the trajectory of the electron beams in opposition to the tube-shaped electrode that is closer to the cathodes, the focus electrode cooperating with the tube-shaped electrode that is closer to the cathodes to generate a quadrupole electric field lens that has a divergent lens action in the horizontal direction and a convergent lens action in the vertical action when the electron beams are not being deflected.

12. An electron gun that is included in a color picture tube, and that emits a plurality of electron beams toward a phosphor screen formed on an inner side of a panel of the color picture tube, comprising:

a plurality of cathodes that are arranged inline;

a pair of main lens-generating tube-shaped electrodes that are provided on a trajectory of the electron beams and generate a main electric field lens, each tube-shaped electrode including at least one correction electrode plate that is positioned away from an opening of the tube-shaped electrode; and a pair of quadrupole lens-generating electrodes that are provided on the trajectory of the electron beams in a position that is closer than the main electric field lens to the phosphor screen, and generate a quadrupole electric field lens that has a convergent lens action in a horizontal direction and a divergent lens action in the vertical direction.

* * * * *